US008511537B2

(12) United States Patent
Billen

(10) Patent No.: US 8,511,537 B2
(45) Date of Patent: Aug. 20, 2013

(54) BUS REPLICA CARTON

(75) Inventor: William D. Billen, Topeka, KS (US)

(73) Assignee: Kid Stuff Marketing, Inc., Topeka, KS (US)

( * ) Notice: Subject to any disclaimer, the term of this patent is extended or adjusted under 35 U.S.C. 154(b) by 403 days.

(21) Appl. No.: 12/646,161

(22) Filed: Dec. 23, 2009

(65) Prior Publication Data

US 2011/0147441 A1 Jun. 23, 2011

(51) Int. Cl.
*B65D 5/42* (2006.01)
*A63H 33/16* (2006.01)

(52) U.S. Cl.
USPC ..... 229/116.4; 206/457; 446/488

(58) Field of Classification Search
USPC ..... 229/116.4, 120.11, 120.18, 904; 446/75, 76, 78, 80, 487, 488; 206/457; D9/672, 675, 676, 677
See application file for complete search history.

(56) References Cited

U.S. PATENT DOCUMENTS

| | | | | |
|---|---|---|---|---|
| 1,547,176 | A | 7/1925 | Lazaron | |
| 1,553,793 | A | 9/1925 | Rozowsky | |
| 2,550,417 | A * | 4/1951 | Klein | 229/116.4 |
| 2,665,522 | A * | 1/1954 | Junod | 446/75 |
| 2,823,844 | A | 2/1958 | Frankenstein | |
| 4,055,250 | A | 10/1977 | Mayhew | |
| 4,643,349 | A | 2/1987 | Sheffer | |
| 4,646,959 | A | 3/1987 | Sheffer | |
| 4,657,520 | A * | 4/1987 | Sheffer | 446/488 |
| 4,661,082 | A | 4/1987 | Sheffer | |
| 4,804,133 | A | 2/1989 | Kiyokane | |
| 5,454,508 | A | 10/1995 | Billen | |
| 5,622,256 | A | 4/1997 | Tesar | |
| 5,890,648 | A * | 4/1999 | Cai | 229/902 |
| D547,396 | S | 7/2007 | Yaguchi | |
| 7,487,903 | B2 | 2/2009 | Billen | |
| D604,634 | S * | 11/2009 | Arora et al. | D9/676 |
| 2008/0029643 | A1 | 2/2008 | Billen | |
| 2008/0257941 | A1 * | 10/2008 | Billen | 229/116.4 |

* cited by examiner

*Primary Examiner* — Gary Elkins
(74) *Attorney, Agent, or Firm* — Erickson Kernell Derusseau & Kleypas, LLC

(57) ABSTRACT

A container for food or other items of interest has a bus-like configuration provided by semi-rigid material having fold lines defining front, rear and sides formed upon assembly of the carton to present a bus-like configuration to maximize the space for holding food or other items of interest and also provide an external display surface for decorative and advertising material.

5 Claims, 3 Drawing Sheets

BUS REPLICA CARTON

This invention relates to cartons which are formed from a sheet of cardboard-like material and have the shape and style of a bus and, in particular, left and right side panels which may be decorated as desired and a top having an opening therein for receiving and holding food or other items within the carton.

BACKGROUND OF THE INVENTION

Disposable cardboard trays and cartons for holding food items have been used by restaurants and theaters as a convenience for their customers and, in particular, to organize and hold food for children and create additional interest by designs that are displayed on the tray or carton. In order to create additional interest and present designs, artwork and words and expressions that a child will recognize, it is desirable to maximize the area of the exterior display surface as well as provide a volume within the carton available for the food or other items. Maximizing the available display area for advertising is also important in addition to contributing to the enjoyment and amusement of the user.

SUMMARY OF THE INVENTION

In an embodiment of the present invention the aforementioned maximization of the capacity of a carton is addressed by providing a carton comprising semi-rigid sheet material having fold lines therein whereby front, rear and sides are formed that present a bus-like configuration, thereby maximizing the space for holding food or other items of interest that may be held and displayed in the carton and also providing an external display surface for decorative and advertising material.

In another aspect of the invention, the bus-like carton is formed by providing a first sheet of semi-rigid material having a base panel that presents a bottom of the carton, a front end portion that extends from a front fold line in the panel, a rear end portion that extends from a rear fold line in the panel, a left side panel that extends from a left side fold line in the panel, and a right side panel extending from a right side fold line in the panel and which, in cooperation with a second sheet of semi-rigid material secured thereto, provides complimentary panels and flaps that cooperate with the first sheet to present the bus-like configuration, the top of the second sheet having an opening therein for receiving and holding food or other items within the assembled carton.

In another aspect of the present invention the sheets of semi-rigid material and associated panels formed therefrom are arranged to present a bus-like configuration when the carton is assembled, a front end portion of the carton projecting forwardly to present a bus-like front.

In yet another aspect of the invention the left and right side panels have replicas of wheels extending therefrom into a base panel prior to assembly, and upon assembly shift into respective positions extending downwardly therefrom to present the wheels, support the carton and provide the carton with a bus-like appearance.

Other advantages of this bus replica carton and method of forming the same will become apparent from the following description taken in connection with the accompanying drawings, wherein is set forth by way of illustration and example, an embodiment of the present invention.

DETAILED DESCRIPTION

Figure 7:
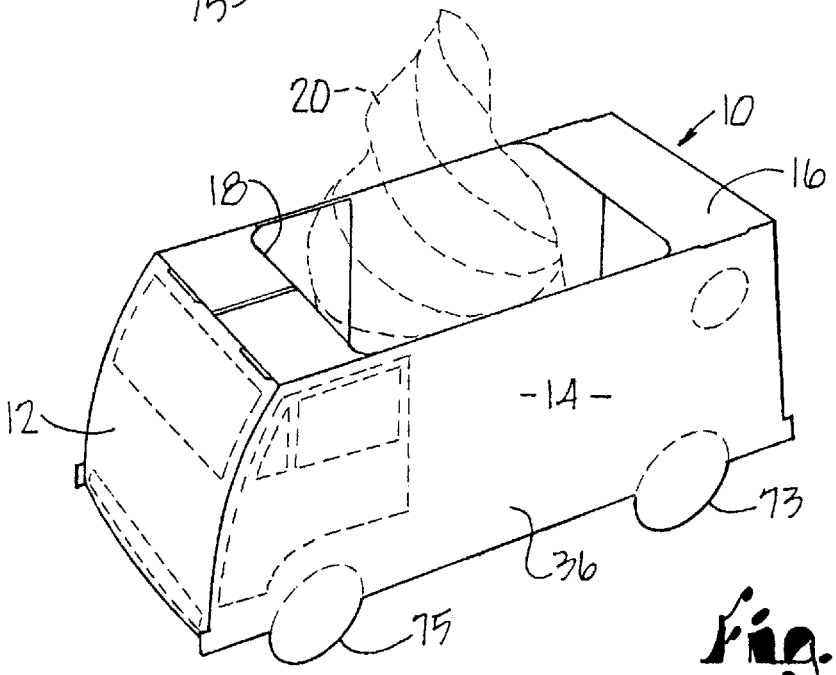
FIG. 7 is a view of the carton fully assembled with features such as the driver's side door and windshield of the bus shown in broken lines, and ice cream held in the bus and projecting from the open top.

Referring initially to FIG. 7, a carton or container 10 for food or other items has a bus-like configuration and is shown fully assembled in a perspective view where the front, facing side and top of the container 10 are shown and designated 12, 14 and 16 respectively. The top 16 has a large rectangular opening 18 therein for receiving and holding a quantity of food items which, in the example shown in FIG. 7, comprises a quantity of ice cream 20 shown in broken lines and extending upwardly through the opening 18 in the top 16. As is apparent, the bus-like container 10 is capable of carrying a significant amount of food or other items for children, in particular, and stimulating a child's interest in the contents of the container.

Figure 1:
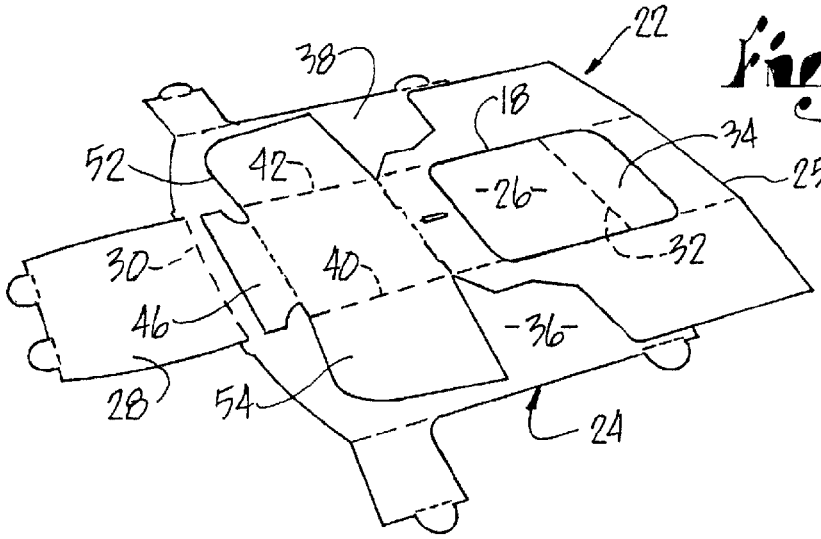
FIG. 1 is a perspective view of an assembly of flat sheet material components having fold lines therein, from which a carton is formed in accordance with the present invention.

FIGS. 1-6 show the manner in which the container 10 is assembled from an initially flat, two-layer sheet of material (FIG. 1) such as paperboard or a similar semi-rigid material having fold lines therein and die cut to the desired shape. Initially, before assembly as shown in FIG. 1, the container 10 comprises an upper sheet section 22 which is a continuation of a lower sheet section 24 and folded thereupon at a rear edge 25. A suitable material is 18 point white C1S SBS stock or a thin plastic material capable of retaining fold lines and being folded to a desired configuration. Other suitable materials may also be used to provide the sheet sections 22 and 24.

Step-by-step assembly of the container 10 is illustrated in FIGS. 1-6. The lower sheet section 24 comprises a base panel 26 extending fore and aft from a front end portion 28 at a first front fold line 30 to a rear fold line 32 from which a rear end portion 34 extends. Left and right side panels 36 and 38, respectively, extend laterally from base panel 26 and, as will be appreciated hereinbelow, are folded upwardly in assembly of the carton along fold lines 40 and 42 respectively. It should be understood that side fold lines 40 and 42 in lower sheet 24 are hidden from view by upper sheet 22 in the illustration of FIG. 1 which shows the flat sheet material components prior to subsequent stages of the assembly illustrated in FIGS. 2-6.

Figure 2:
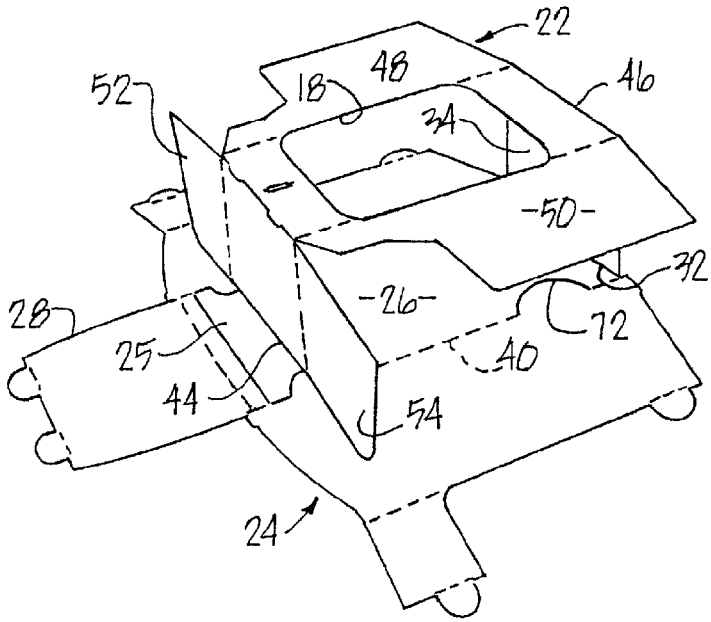
FIG. 2 is a view similar to FIG. 1 but with the upper sheet of FIG. 1 folded to a position presenting the top of the bus replica carton with panels projecting therefrom.
Figure 3:
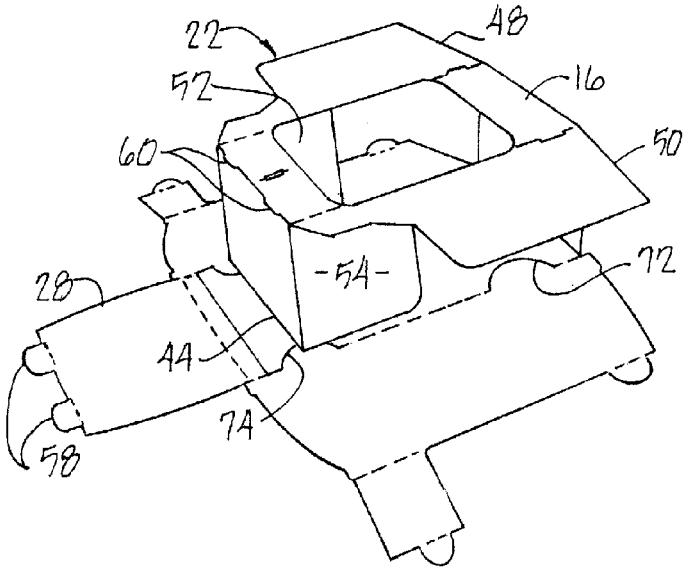
FIG. 3 is a view similar to FIG. 2 showing the next stage of assembly wherein forward panels are folded back.
Figure 4:
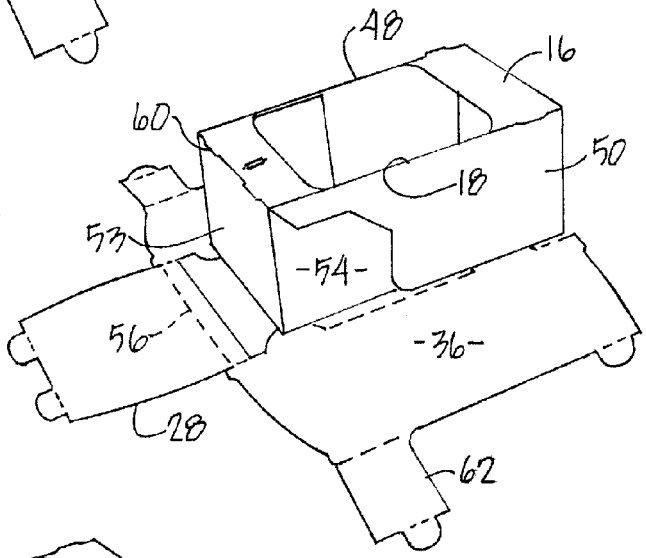
FIG. 4 is a view similar to FIG. 3 showing a subsequent stage in which the side panels have been folded down.

Referring to FIG. 2, upper sheet 22 is shown in a first stage of assembly wherein the sheet is swung about a front, laterally extending edge 44 defining a line of fold, and upper and lower, rear fold lines 46 and 32 respectively. The upper sheet 22 thus presents the large rectangular, central opening 18 at the top of the carton as viewed in FIGS. 2-7 and is secured at edge 44 to lower sheet 24 by a forwardly extending tongue 25 glued to lower sheet 24 at the left end thereof adjacent front end portion 28. At this stage of assembly, the upper sheet 22 presents opposed side flaps 48 and 50 which, in FIG. 4, are shown folded downwardly to upright positions. As may be appreciated from viewing the stages of assembly shown in FIGS. 2 and 3, opposed panels 52 and 54 initially extending laterally outwardly at the front end of upper sheet 22 are folded to the rear as shown in FIGS. 3 and 4. Side flaps 48 and 50 are then folded downwardly and lie in essentially vertical planes as seen in FIG. 4.

In a subsequent step front end portion 28 is swung upwardly about a front fold line 56 to present the front of the bus, and is held in place by a pair of laterally spaced tabs 58 projecting from the distal end of front end portion 28 and received in corresponding slots 60 at the top of the front panel 53. As may be appreciated from viewing FIGS. 5, 6 and 7, this imparts a curvature to front end portion 28 that simulates the front of a bus that may be decorated as desired (FIG. 7) and presents a bus-like appearance including a front windshield, bumper and lights, and an entry door as illustrated in FIG. 7. It may also be appreciated that the assembled bus in FIG. 7 is styled and decorated as desired to provide an attractive container, particularly to stimulate a child's interest in the contents thereof, or for advertising.

Figure 5:
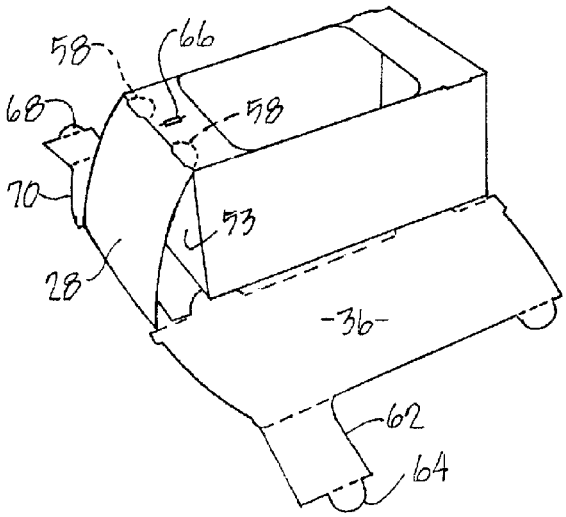
FIG. 5 is a subsequent stage of assembly in which a front end portion of the bus is folded upwardly and connected to the top of the carton to present the front of the bus-like carton.
Figure 6:
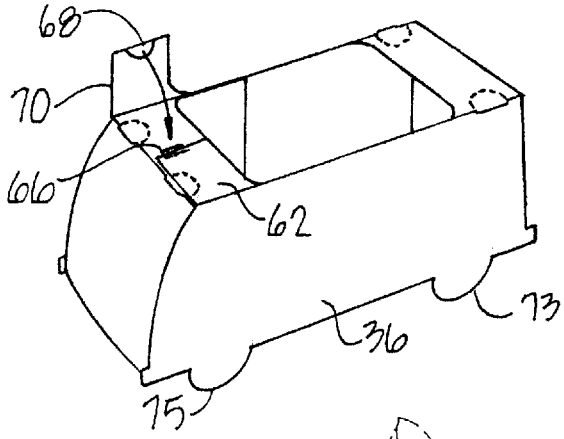
FIG. 6 is a subsequent stage of assembly showing the left and right side panels folded upwardly to present the sides of the bus-like carton.

Completion of the assembly is illustrated by a comparison of FIGS. 5 and 6 where it may be seen that the left and right side panels 36 and 38 fold upwardly at respective fold lines 40 and 42 to close the sides of the carton. Left top segment 62 projects from the left side panel 36 and has a distal tab 64 that is received by a slot 66 on the top of the carton over the cab of the stimulated bus, and a tab 68 on a right top segment 70 is likewise inserted into slot 66 as illustrated in FIG. 6.

Additionally, referring to FIG. 2, it may be seen that the lower sheet 24 has an essentially semi-circular cut 72 therein which presents approximately the bottom half of a wheel 73 for the bus carton when it is fully assembled as shown in FIG. 7. A simulated front wheel 75 is also formed by the steps of assembly set forth above as it may be appreciated viewing FIG. 3, for example, that an essentially semi-circular cut 74 creates the front wheel 75 of the bus when it is fully assembled. It should be appreciated that although the left side of the bus is shown in detail, the opposing, right side is a mirror image thereof and thus the container is supported by a pair of simulated front wheels and a pair of simulated rear wheels. Furthermore, the carton of the present invention provides a substantial interior volume available for food or other items as illustrated by the quantity of ice cream 20 shown in phantom lines in FIG. 7. In addition to substantially the entire interior volume being available for food or other items of interest, the external area provided by the side panels 36 and 38 maximizes the display area available for fanciful and decorative displays or advertising.

It is to be understood that while certain forms of this invention have been illustrated and described, it is not limited thereto, except insofar as such limitations are included in the following claims.

Having thus described the invention, what is claimed as new and desired to be secured by Letters Patent is as follows:

1. A method of forming a carton for food or other items having a simulated bus configuration, said method comprising the steps of:

providing a lower sheet of semi-rigid material having a base panel presenting a bottom of said carton, a front end portion extending from a front fold line in said base panel, a rear end portion extending from a rear fold line in said base panel, a left side panel extending from a left side fold line in said base panel, and a right side panel extending from a right side fold line in said base panel, providing an upper sheet of semi-rigid material having front and rear edges, said upper sheet including a tongue extending from said front edge, the tongue being secured to said base adjacent to said front fold line, said rear edge being secured to said rear end portion at said rear fold line, and rotating said second sheet about said front and rear edges to an upstanding position presenting a top of said carton, providing said second sheet with laterally extending flaps and folding said flaps and said left and right side panels to respective positions closing the sides of said carton when said second sheet is in said upstanding position, folding said front end portion about said front fold line to a position presenting the front of the carton, a distal edge of said front end portion coupling to said second sheet, said front end portion being dimensioned to impart a curvature in said front end portion when coupled to said second sheet, and providing said top of the second sheet with an opening therein for receiving and holding food or other items within said carton.

2. A carton for food or other items having a simulated bus configuration, said carton comprising:

a first, lower sheet of semi-rigid material having a base panel presenting a bottom of said carton, a front end portion extending upwardly from a first front fold line in said panel, a rear end portion extending upwardly from a rear fold line in said panel, a left side panel extending upwardly from a left side fold line in said panel, and a right side panel extending upwardly from a right side fold line in said panel, a second, upper sheet of semi-rigid material having a front edge secured to said lower sheet at a second front fold line spaced rearwardly from said first front fold line, and a rear edge secured to said rear end portion, said second sheet having an upstanding position presenting a top of said carton, said second sheet having means cooperating with said left and right side panels to close the sides of said carton when the second sheet is in said upstanding position, and said front end portion being folded upwardly about said first front fold line and coupling to said second sheet, said front end portion being dimensioned to impart a forwardly projecting curvature that presents a bus-like front of the carton, and said top of the second sheet having an opening therein for receiving and holding food or other items within said carton.

3. The carton as claimed in claim 2, wherein said second sheet is rotated about said second front fold line and said rear fold line to said upstanding position presenting said top of said carton.

4. The carton as claimed in claim 3, wherein said means cooperating with said left and right side panels comprises flaps folded to respective positions cooperating with said left and right side panels to close the sides of said carton when the second sheet is in said upstanding position.

5. The carton as claimed in claim 2, wherein said left and right side panels have simulated wheels extending therefrom into said base panel which shift into respective positions extending downwardly therefrom for supporting the carton and further providing the carton with a simulated bus appearance.

* * * * *